US005437345A

United States Patent [19]

Schmidt et al.

[11] Patent Number: 5,437,345

[45] Date of Patent: Aug. 1, 1995

[54] PINNABLE WATERWAY

[75] Inventors: Frances E. Schmidt; Randy W. Zimmer, both of Appleton; Wendy L. Schultz, Neenah, all of Wis.

[73] Assignee: Pierce Manufacturing Inc., Appleton, Wis.

[21] Appl. No.: 197,035

[22] Filed: Feb. 16, 1994

[51] Int. Cl.[6] ..... E06C 7/00

[52] U.S. Cl. ..... 182/129; 248/77

[58] Field of Search ..... 182/129; 248/77, 78, 248/231.3; 169/24, 25

[56] References Cited

U.S. PATENT DOCUMENTS

| | | | |
|---|---|---|---|
| 451,708 | 5/1891 | Crafts | 169/25 X |
| 1,451,006 | 4/1923 | Blaw . | |
| 1,583,772 | 5/1926 | Blaw . | |
| 1,726,649 | 9/1929 | Callaghan . | |
| 2,227,779 | 1/1941 | Grant . | |
| 2,593,921 | 4/1952 | Robinson . | |
| 3,675,721 | 7/1972 | Davidson . | |
| 4,007,793 | 2/1977 | Hux . | |
| 5,228,796 | 7/1993 | Kao | 248/231.3 X |

FOREIGN PATENT DOCUMENTS

| | | | |
|---|---|---|---|
| 621226 | 4/1949 | United Kingdom | 169/25 |

*Primary Examiner*—Alvin C. Chin-Shue

*Attorney, Agent, or Firm*—Wheeler & Kromholz

[57] ABSTRACT

An apparatus for connecting a waterway, having a nozzle, to various sections of an aerial ladder. The connecting apparatus comprises an off-set cam within a cylindrical sleeve. One end of a connecting link is attached to the cylindrical sleeve. The other end fits within the clevises attached to the different sections of the ladder and has an aperture for receiving a clevis pin which is passed through the clevis and connecting link to attach the waterway to the selected ladder section. To firmly lock the waterway to the ladder section, a rotatable shaft, supported by bearings and having one end attached to the off-set axis of the cam, is rotated by means of a handle located on the exterior of the bracket. The rotation of the shaft and cam urge the waterway bracket against a step on the selected ladder section and thus securely lock the waterway in place.

11 Claims, 3 Drawing Sheets

PINNABLE WATERWAY

BACKGROUND OF THE INVENTION

A great aid to fire fighters in extinguishing fires from aerial ladders is the waterway. A waterway is a device used on fire trucks and other fire fighting equipment. A waterway typically includes a monitor bracket attached to an aerial ladder of a fire truck or other fire fighting apparatus and a nozzle attached to the bracket for spraying water or extinguishing chemicals onto the fire. In addition, there is a means of supplying the water or chemicals to the waterway nozzle. The waterway extends and contracts with the aerial ladder of a fire truck or other fire fighting apparatus. The nozzle may have a fixed position, be operated by a fire fighter on the ladder at the waterway, or be controlled at a remote location by a controlling means.

The function of the waterway is to provide a means for spraying water or other extinguishing chemicals on a fire. Once set-up and operating, it continues to spray the fire with limited involvement by the fire fighters. Thus they are free to set-up and operate additional fire fighting equipment. One common application of the waterway is where it is unsafe for a fire fighter to be located within a close proximity to the fire. A waterway attached to an aerial ladder can be employed and spray water on the fire without the presence of the fire fighter. After the fire truck is positioned, its aerial ladder including the waterway can be extended upward and diagonally toward the fire. When in the desired location, water is pumped from the truck through the telescopic piping to the waterway nozzle.

To make a waterway a more effective tool for fire fighting, it should have the capability to be connected to different sections of the aerial ladder. The location of the waterway is determined by the size and location of the fire, whether the ladder will be simultaneously used by fire fighters for other purposes, and what other fire fighting equipment might be operated from the ladder.

One of the drawbacks with present waterways is that they can only be attached to one section of an aerial ladder. Other waterways can be attached to different sections of the aerial ladder, but it is difficult and requires a great effort to disconnect and reconnect the waterway. These waterways utilize the rungs of an aerial ladder to connect the waterway to the ladder. When the ladder is collapsed, these waterways can only be attached to the top section of the collapsed ladder, called the fly section. This section extends the farthest. In order to connect the waterway to a section of the ladder other than the fly-section, the aerial ladder must first be fully extended exposing the section to which the waterway will be connected before the connection can be made.

This invention relates to a unique and novel means for easily attaching and detaching the waterway to different sections of an aerial ladder. Furthermore, the choice of which section the waterway should be connected to can be made at the scene of the fire and regardless of what section is chosen, the aerial ladder need not be extended first.

It is an object of the present invention to provide a waterway that can be removably attached to different sections of an aerial ladder. Another object of the invention to provide an apparatus for such removal and attachment that is of a simple design and easy to operate. It is a further object of this invention to provide a waterway that is securely attached to the underside of the aerial ladder so that the waterway does not interfere in any way with fire fighter ascending and descending the ladder while the water way is in use.

SUMMARY OF THE INVENTION

The present invention, a pinnable waterway, comprises a waterway that can be removably attached to different sections of an aerial ladder. Such ladders are typically found on a fire truck or other fire fighting apparatus. The waterway includes a monitor bracket attached to the aerial ladder which supports a nozzle for spraying water or extinguishing chemicals on a fire. An extendable and collapsible pipe, attached to the underside of the aerial ladder, supplies the liquid to the waterway nozzle.

The pinnable waterway monitor bracket includes an off-set cam locking device enabling the waterway to be easily connected to different sections of the aerial ladder. Before the ladder is extended, the waterway is connected to the desired section of the ladder, typically the end of the mid-section or the end of the fly-section, and then locked into place. When the aerial ladder is extended outward and upward, the waterway extends with the section to which it is attached.

The connecting and locking mechanism of the waterway includes a round cam having an off-set axis that fits within a cylindrical sleeve having an interior and an exterior surface; the cam being rotatably contained within the cylindrical sleeve. A connecting link is attached to the exterior or outer surface of the sleeve. Clevises are attached to various sections of the aerial ladder, typically the end of the mid-section and the end of the fly-section. The connecting link fits into the selected clevis. A connecting mechanism, clevis pin, preferably with a locking clip, passes through the first end of the clevis, the connecting link, and the second end of the clevis securing the waterway to the selected section of the ladder.

A shaft, supported by bearings, is attached to the cam for purposes of rotating the cam on its off-set axis. The shaft extends from the cam through the side of the water monitor bracket. A locking lever is attached on the end of the shaft opposite the cam outside of the water monitor bracket. Once the connecting link is pinned into the selected clevis, the cam is rotated by rotating the locking lever approximately ninety degrees. The cam turns within the sleeve and urges the waterway against a stop that corresponds with the selected ladder section. When the locking lever and cam have been rotated 90 degrees into an over-center position, the waterway is locked into the selected section of the aerial ladder. In this position, the locking lever rests against a stop. The waterway is now securely attached and locked to the section of the ladder where the clevis is located. The aerial ladder can now be extended and the waterway will extend with the section to which it is attached.

After the ladder is lowered and collapsed, the waterway can be disconnected from one section of the ladder and reconnected to another. First, the operator removes the safety clip from the clevis cam and lifts the locking lever to unload the clevis pin. Next, the operator removes the clevis pin and places the locking lever in the vertical position. The operator can now rotate the connecting link approximately 180 degrees from the clevis attached to the fly-section of the ladder to the clevis attached to the mid-section of the ladder or vice versa. After the connecting link is aligned within the clevis, the clevis pin is inserted and the safety clip installed. The waterway can then be locked into position by pushing the locking lever forward until it stops for the fly-section or by pushing the locking lever backward until it stops for the mid-section attachment. When the locking lever is engaged, the cam rotates thus removing any slack between the clevis and the connecting link. When the locking lever comes to rest against one of the stops, the cam has been rotated into an over-center position thus locking the waterway and aerial ladder section together.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
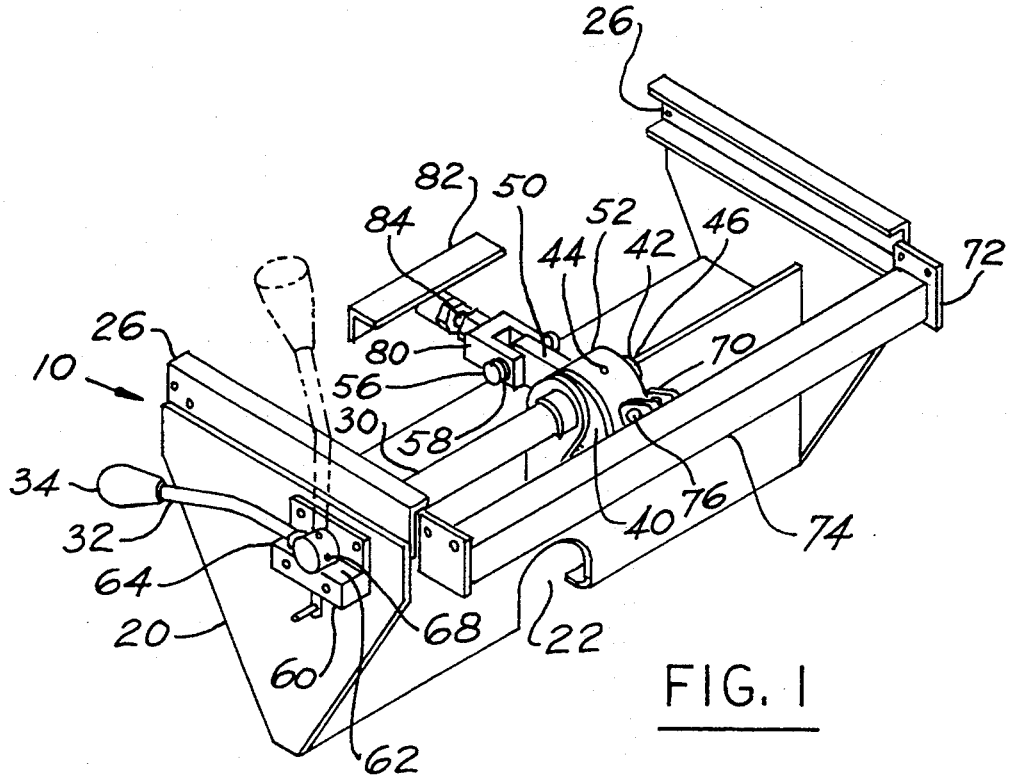
FIG. 1 is a top perspective view of the pinnable waterway showing the pinnable waterway connected to the mid-section of the aerial ladder.
Figure 2:
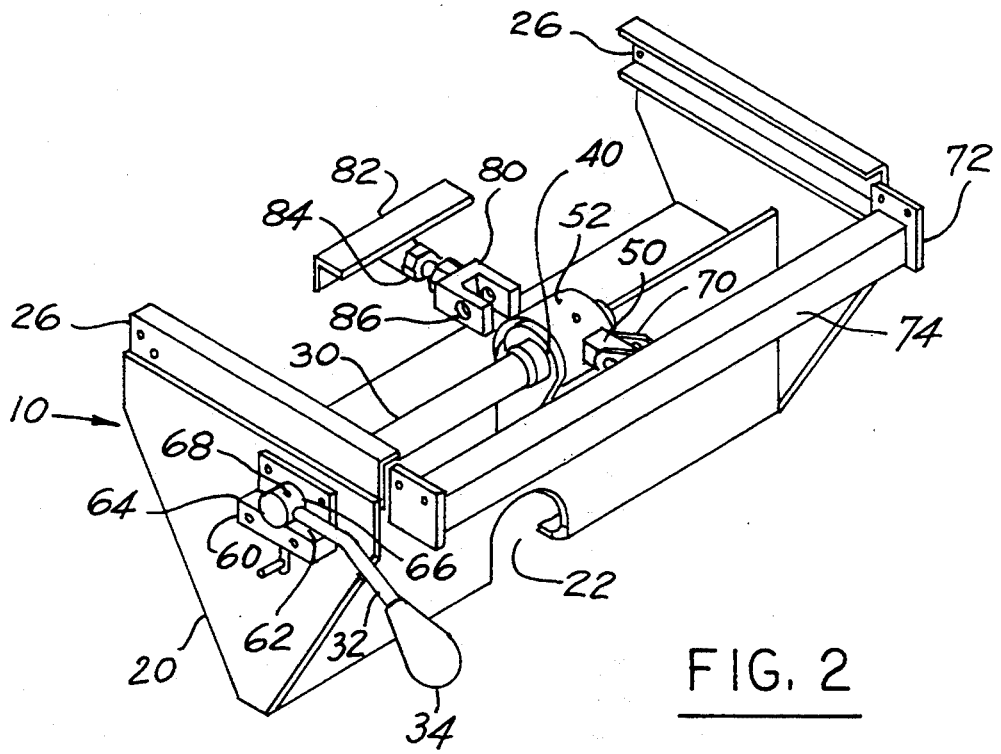
FIG. 2 is a top perspective view of the pinnable waterway showing the pinnable waterway connected to the fly-section of the aerial ladder.

With reference to the drawings in general, and to FIGS. 1 and 2 in particular, the pinnable waterway is generally shown as 10.

As shown in FIGS. 1 and 2, the pinnable waterway comprises a monitor bracket 20, a shaft 30 with a locking lever 32, a round cam 40 having an off-set axis 46, a connecting linking 50 attached to a cylindrical sleeve 52, and a bearing block 60 with a front stop 62 and a rear stop 64. Monitor bracket 20 has channels 26 on each side as shown in FIGS. 1 and 2. The bottom side rails 112 of fly-section 72 of aerial ladder 110 fit into the channels 26.

Figure 3:
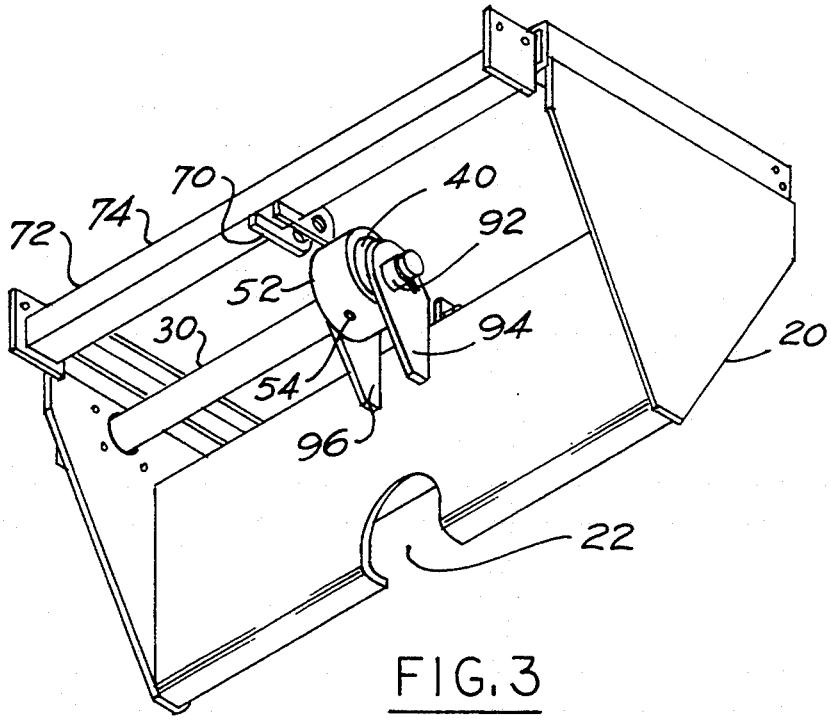
FIG. 3 is a bottom perspective view of the pinnable waterway.
Figure 4:
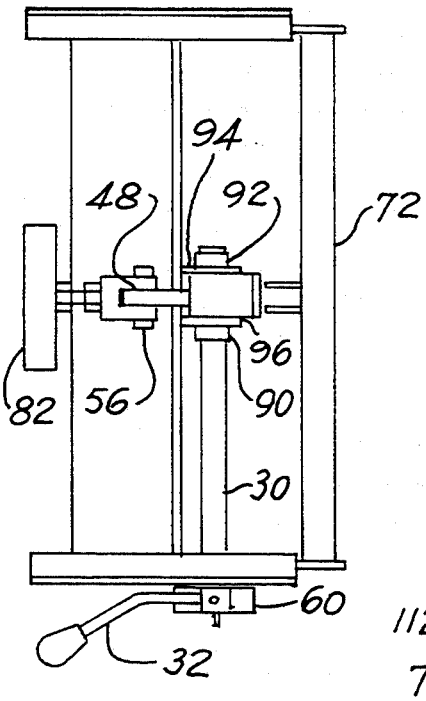
FIG. 4 is a top view of the pinnable waterway showing the pinnable waterway connected to the mid-section of the aerial ladder.

A first clevis 70 is attached, preferably by welding to cross-member 74 as best shown in FIG. 3, to the front Of the fly-section 72 of the aerial ladder 110. A similar clevis 80 is attached to the front of the mid-section 82 of the aerial ladder 110 by an adjustable coupling 84 as shown in FIG. 1. Shaft 30 is supported by bearing block 60, as shown in FIGS. 1, 2 and 3, and by bearings 90 and 92 attached to bearing supports 96 and 94 respectively, as shown in FIGS. 3 and 4. Cam 40 has an aperture 42 through its off-set axis 46 whose diameter is slightly larger than the diameter of shaft 30. The end of shaft 30 is inserted into the cam aperture 42 and is attached by a roll pin 44 which is inserted through aperture 54 in cylindrical sleeve 52 as shown in FIG. 3. Cam 40 is inserted into and rotates freely within the interior surface of cylindrical sleeve 52. The ends of roll pin 44 are contained completely within aperture 42 of cam 40 so that they do not contact the interior surface and interfere with the rotation of cam 40 with respect to cylindrical sleeve 52. When locking lever 32 is rotated clockwise or counter-clockwise, shaft 30 rotates on bearings 60, 90, and 92 and cam 40 also rotates within cylindrical sleeve 52. Locking lever 32 has a knob 34 on its end.

Connecting link 50 is welded to the outer surface of cylindrical sleeve 52. When the locking lever 32 is in its vertical or upright position at a ninety degree angle to the aerial ladder 110, the off-set axis 46 of cam 40 is centered within cylindrical sleeve 52. When locking lever 32 is in this upright unlocked position, as shown in phantom in FIG. 1, and connecting link 50 is rotated into the clevis (70 or 80) attached to the section of the aerial ladder to which the fire fighter wants the waterway attached, the connecting link aperture 48 and clevis apertures 76 or 86 align. Also, the tolerance and play between aperture 48 of connecting link 50 and the apertures 76 or 86 of clevis 70 or 80 is great. The clevis pin 56 can be easily removed or inserted in this position.

When the clevis pin 56 has been removed from the presently connected clevis, connecting link 50 and cylindrical sleeve 52 can be freely rotated around cam 40 and into the opposite clevis. Then clevis pin 56 is inserted through the first aperture of the first prong of the selected clevis, the connecting link aperture 48, and the second aperture of the second prong of the selected clevis. Next, the safety clip 58 is attached to the end of clevis pin 56 to prevent its removal. If the connecting link 50 has been attached to clevis 70 at the front or fly-section of the aerial ladder, locking lever 32 is rotated clockwise toward the front of the ladder in order to lock the waterway into position as shown in FIG. 2. As locking lever 32 is engaged, cam 40 rotates on its off-set axis 46 and removes the play between connecting link 50 and fly-section clevis 70. The off-set axis 46 of cam 40 causes the waterway 10 to be biased forward toward cross-member 74 of fly-section 72. Cross-member 74 acts as a stop. The cam 40 rotates into an over-center locked position just prior to locking lever 32 coming to rest against stop 62. When locking lever 32 is fully rotated and rests against stop 62 on bearing block 60, the waterway is securely locked to the fly-section of the aerial ladder.

Figure 5:
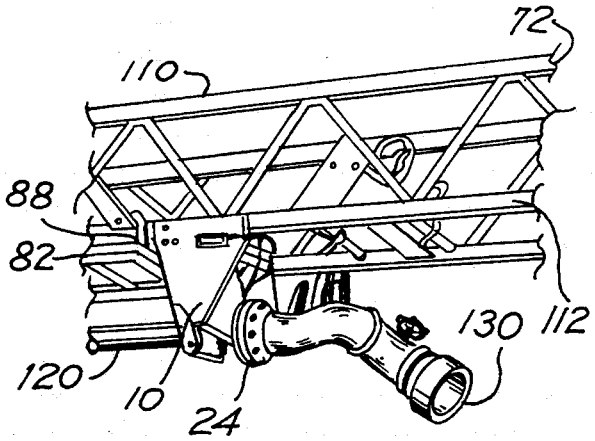
FIG. 5 is a perspective view showing the waterway and nozzle attached to the mid-section of the aerial ladder.

Alternatively, connecting link 50 can be rotated into clevis 80 attached to the mid-section of aerial ladder 110. Afar the clevis pin 56 is inserted and locked with safety clip 58, locking lever 32, shaft 30, and 40 are rotated counter-clockwise to remove the play between clevis 80 and connecting link 50 as shown in FIG. 1. As the cam 40 rotates in the opposite direction within cylindrical sleeve 52, it biases waterway 10 toward the end 88 of mid-section 82. As shown in FIG. 5, the end 88 of mid-section 82 also acts as a stop. The cam 40 rotates into an over-center locked position just prior to locking lever 32 coming to rest against stop 64. When locking lever 32 is fully rotated and rests against stop 62 on bearing block 60, the waterway is securely locked to the fly-section of the aerial ladder.

Figure 6:
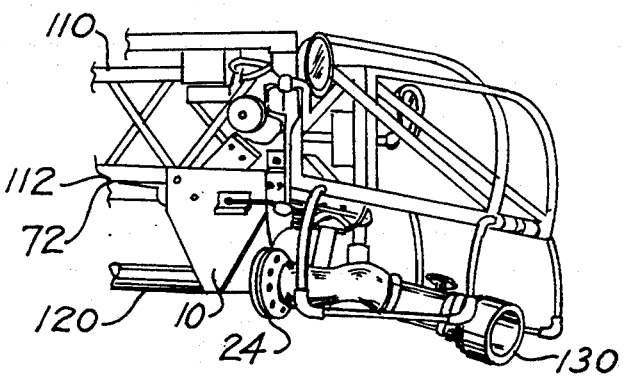
FIG. 6 is a perspective view showing the waterway and nozzle attached to the fly-section of the aerial ladder.

Water monitor bracket 20 has a semi-circular opening 22 as shown in FIGS. 1, 2, and 3. A nozzle 130 is attached to the front side of this opening 22 with a flange 24, as shown in FIGS. 5 and 6. The extendable and collapsible piping for supplying water to the nozzle 130 is attached with an identical flange 24 on the opposite side of the water monitor bracket 20.

Figure 7:
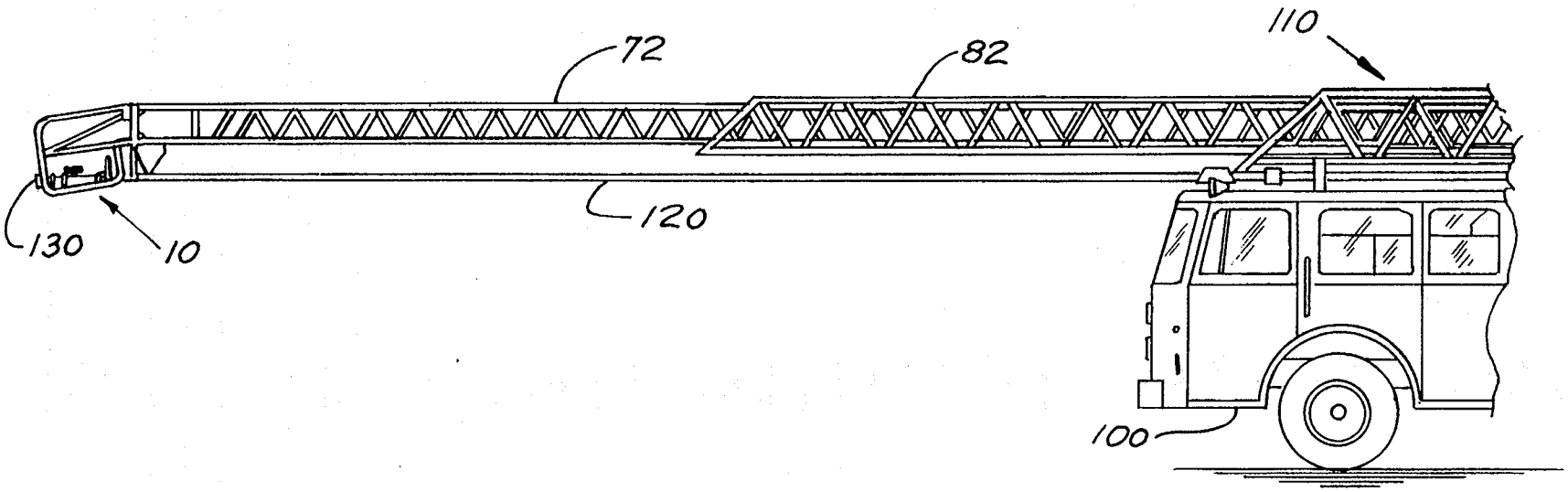
FIG. 7 is a side elevational view of a fire truck and an extended aerial ladder showing the waterway connected at the end of the fly-section of the aerial ladder.

FIG. 5 shows the pinnable waterway 10 attached to the end of mid-section 82 of the aerial ladder 110. FIG. 6 shows pinnable waterway 10 attached to the end of the fly-section 72 of the aerial ladder 110. FIG. 7 shows fire truck 100, aerial ladder 110, and pinnable waterway 10 attached to the end of the fly-section 72. Also shown is the extendable and collapsible piping 120 for supplying water or other liquids to the nozzle 130 attached to the pinnable waterway 10.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for connecting a waterway to a section of a ladder, the apparatus comprising:

an attachment means attached to the ladder;

a sleeve having an exterior surface with a connecting link attached thereto;

a cam having an off-set axis rotatably contained within the sleeve;

a connecting means for connecting the connecting link to the attachment means of the ladder;

a rotating means connected to the cam at the off-set axis for rotating the cam and moving the connecting link into and out of a locked position.

2. The apparatus of claim 1 further including a locking means for locking the rotating means into the locked position.

3. The apparatus of claim I wherein the rotating means comprises a shaft having two ends, the first end attached to the off-set axis of the cam and the second end attached to a locking handle.

4. The apparatus of claim 1 wherein the connecting means comprises a clevis pin with a locking clip.

5. An apparatus for removably attaching a waterway to either the mid-section or fly-section of an aerial ladder, the apparatus comprising:

a first attachment means attached to the mid-section of the ladder;

a second attachment means attached to the fly-section of the ladder;

a connecting link;

a connecting means to connect the connecting link to one of the attachment means;

a sleeve, having a rotatable cam with an off-set axis located therein, attached to the connecting link;

a rotating means connected to the off-set axis of the cam for rotating the cam and moving the connecting link, relative to one of the attachment means, into or out of a locked position.

6. The apparatus of claim 5 wherein the first and second attachment means comprise clevises.

7. The apparatus of claim 5 wherein the connecting means comprises a clevis pin with a locking clip.

8. The apparatus of claim 5 wherein the rotating means comprises a shaft having two ends, the first end attached to the off-set axes of the cam and the second end attached to a locking handle.

9. A waterway for attachment of a nozzle to at least one section of an aerial ladder, the waterway comprising:

a bracket slidably engaged into at least one section of the ladder;

a rotatable link having an aperture for receiving a connecting pin and a locking means for locking the waterway to the ladder, the rotatable link and locking means being attached to the bracket;

a receiving means for receiving the rotatable link, the receiving means being attached to the ladder.

10. A waterway for attachment of a nozzle to at least one section of an aerial ladder, the waterway comprising:

a bracket slidably engaged into at least one section of the ladder;

a connecting means for connecting the waterway to the ladder, the connecting means being attached to the bracket;

an off-set cam positioned within a cylindrical sleeve having a connecting link attached thereto, the cylindrical sleeve being attached to the bracket;

a rotating means for rotating the cam into and out of a locked position, the rotating means being connected to the cam;

a receiving means for receiving the connecting means, the receiving means being attached to the ladder.

11. A waterway for attachment of a nozzle to least one section of an aerial ladder, the waterway comprising:

a bracket slidably engaged into at least one section of the ladder;

a connecting means for connecting and a locking means for locking the waterway to the ladder, the connecting means and locking means being attached to the bracket;

at least a receiving means for receiving the connecting means, the receiving means comprises one clevis fixedly attached to a section of the aerial ladder.

* * * * *